US010145651B2

(12) United States Patent
Cheng

(10) Patent No.: US 10,145,651 B2
(45) Date of Patent: Dec. 4, 2018

(54) ADJUSTING KNOB MECHANISM

(71) Applicants: Sintai Optical (Shenzhen) Co., Ltd., ShenZhen, Guandong Province (CN); Asia Optical Co., Inc., Taichung (TW)

(72) Inventor: Sung-Po Cheng, Taichung (TW)

(73) Assignees: SINTAI OPTICAL (SHENZHEN) CO., LTD., Shenzhen, Guangdong Province (CN); ASIA OPTICAL CO., INC., Taichung (TW)

( * ) Notice: Subject to any disclaimer, the term of this patent is extended or adjusted under 35 U.S.C. 154(b) by 0 days.

(21) Appl. No.: 15/791,542

(22) Filed: Oct. 24, 2017

(65) Prior Publication Data

US 2018/0209763 A1 Jul. 26, 2018

(30) Foreign Application Priority Data

Jan. 23, 2017 (CN) ..... 2017 1 0058905

(51) Int. Cl.
*F41G 1/18* (2006.01)
*G05G 5/00* (2006.01)

(52) U.S. Cl.
CPC ..... *F41G 1/18* (2013.01); *G05G 5/00* (2013.01)

(58) Field of Classification Search
CPC ..... F41G 1/16; F41G 1/18; F41G 1/20; F41G 1/26; F41G 1/38
USPC ..... 42/135, 136, 137, 138, 139
See application file for complete search history.

(56) References Cited

U.S. PATENT DOCUMENTS 2,811,894 A * 11/1957 Braker ..... F41G 1/38 356/21
4,080,043 A * 3/1978 Altenheiner ..... G02B 7/06 359/416
6,351,907 B1 * 3/2002 Otteman ..... F41G 1/38 42/120
8,006,429 B2 * 8/2011 Windauer ..... F41G 1/38 42/119
8,806,798 B2 * 8/2014 Crispin ..... F41G 1/38 42/119
8,919,026 B2 * 12/2014 Hamilton ..... F41G 1/38 42/119
9,677,848 B2 * 6/2017 Hamilton ..... F41G 1/38
9,958,666 B2 * 5/2018 Ingenito ..... G02B 7/023
9,989,362 B2 * 6/2018 Ottl ..... F41G 1/38
(Continued)

*Primary Examiner* — Joshua E Freeman
(74) *Attorney, Agent, or Firm* — McClure, Qualey & Rodack, LLP

(57) ABSTRACT

In an adjusting knob mechanism, a base includes a first supporting portion and a second supporting portion. A first clicking gear includes a plurality of first indentations and disposed on the first supporting portion. A second clicking gear includes a plurality of second indentations and disposed on the second supporting portion. A limiting element is disposed on the base. A movable element is disposed within the limiting element and configured to move in an axial direction of the base relative to the limiting element. A connecting mechanism extends into the limiting element. An adjusting cover is connected to the movable element by the connecting mechanism, so as to move the movable element in the axial direction of the base relative to the limiting element and the second clicking gear. The adjusting cover is configured to rotate the limiting element and the movable element through the connecting mechanism.

19 Claims, 6 Drawing Sheets

(56) References Cited

U.S. PATENT DOCUMENTS

| | | | | |
|---|---|---|---|---|
| 2007/0137089 | A1* | 6/2007 | William, III | F41G 1/38<br>42/122 |
| 2008/0289239 | A1* | 11/2008 | Menges | F41G 1/38<br>42/125 |
| 2010/0175298 | A1* | 7/2010 | Thomas | F41G 1/18<br>42/122 |
| 2012/0154907 | A1* | 6/2012 | Schmitt | F41G 1/38<br>359/399 |
| 2015/0316350 | A1* | 11/2015 | Hamilton | F41G 1/38<br>42/122 |

* cited by examiner

ADJUSTING KNOB MECHANISM

BACKGROUND OF THE INVENTION

Field of the Invention

The invention relates to an adjusting knob mechanism, and more particularly to an adjusting knob mechanism capable of performing coarse and fine adjustments.

Description of the Related Art

Generally, a conventional sight is provided with an adjusting knob mechanism for correcting bullet impact points. The adjusting knob mechanism has a clicking gear on which a plurality of grooves are formed and equally spaced. In operation, the adjusting knob mechanism is rotated to move a steel ball between the grooves with clicking sounds made for noticing the user. However, if changing the clicking sounds during operation is desired, the elements within the adjusting knob mechanism or even the whole adjusting knob mechanism is needed to be replaced. That is inconvenient in use.

BRIEF SUMMARY OF THE INVENTION

The invention provides an adjusting knob mechanism having two clicking gears disposed therein, so that the adjusting knob mechanism can make clicking sounds of different time intervals by moving ball members on the clicking gears. Further, the adjusting knob mechanism can be controlled to make clicking sounds with a desired time interval therebetween by changing position of an adjusting cover.

The adjusting knob mechanism in accordance with an embodiment of the invention includes a base, a first clicking gear, a second clicking gear, a limiting element, a movable element, a connecting mechanism and an adjusting cover. The base includes a first supporting portion and a second supporting portion. The first clicking gear includes a plurality of first indentations and disposed on the first supporting portion. The second clicking gear includes a plurality of second indentations and disposed on the second supporting portion. The limiting element is disposed on the base. The movable element is disposed within the limiting element and configured to move in an axial direction of the base relative to the limiting element. The connecting mechanism extends into the limiting element. The adjusting cover is connected to the movable element by the connecting mechanism, so as to move the movable element in the axial direction of the base relative to the limiting element and the second clicking gear. The adjusting cover is configured to rotate the limiting element and the movable element through the connecting mechanism.

In another embodiment, the connecting mechanism includes at least two fixing screws, each of the fixing screws includes a first end portion and a second end portion, the first end portion is connected to the adjusting cover, and the second end portion extends through the limiting element and is connected to the movable element.

In yet another embodiment, the movable element is movable relative to the limiting element to be positioned in a first position or a second position.

In another embodiment, the limiting element includes at least one engaging structure, the engaging structure is configured to engage with the movable element in the first position or the second position, the movable element includes inner circumferential walls on which a first groove and a second groove are provided, the first position corresponds to the first groove, the second position corresponds to the second groove, and both of the first groove and second groove are annular grooves.

In yet another embodiment, the engaging structure includes an elastic element and a ball member, a hole is formed on the limiting element, the elastic element and the ball member are disposed in the hole of the limiting element, and the ball member is forced to engage with the first groove or the second groove by an elastic force generated by the elastic member.

In another embodiment, the limiting element includes a planar portion. When the movable element is positioned in the first position, the adjusting cover is positioned in a third position, the limiting element is placed against the first clicking gear, and the movable element is placed against the planar portion of the limiting element. When the movable element is positioned in the second position, the adjusting cover is positioned in a fourth position, the limiting element is placed against the first clicking gear, and the movable element is placed against the second clicking gear.

In yet another embodiment, the limiting element includes at least one first elastic element and at least one first ball member, a first hole is formed on the limiting element, the first elastic element and the first ball member are disposed in the first hole of the limiting element, and the first clicking gear further includes a plurality of planes formed between the first indentations. When the movable element is positioned in the first position or the second position, the first ball member is forced against the first clicking gear by a first elastic force generated by the first elastic member. When the limiting element is rotated, the first ball member is moved to the first indentations and onto the planes alternately.

In another embodiment, the movable element includes at least one second elastic element and at least one second ball member, a second hole is formed on the movable element, the second elastic element and the second ball member are disposed in the second hole of the movable element. When the movable element is positioned in the second position, the second ball member is forced against the second clicking gear by a second elastic force generated by the second elastic member. When the movable element is rotated, the second ball member is moved between the second indentations.

In yet another embodiment, the adjusting knob mechanism further includes an indicating ring and a decoration ring, wherein the indicating ring includes an index, the decoration ring is provided with an opening, the indicating ring is disposed outside the base, the decoration ring is disposed outside the indicating ring, and the opening is placed to expose the index.

In another embodiment, the adjusting cover includes a fine-tuning scale, the limiting element includes a coarse-tuning scale; the index and the coarse-tuning scale are visible through the opening when the movable element is positioned in the first position; and the index and the fine-tuning scale is visible through the opening when the movable element is positioned in the second position.

A detailed description is given in the following embodiments with reference to the accompanying drawings.

BRIEF DESCRIPTION OF THE DRAWINGS

The invention can be more fully understood by reading the subsequent detailed description and examples with references made to the accompanying drawings, wherein.

DETAILED DESCRIPTION OF THE INVENTION

Figure 1:
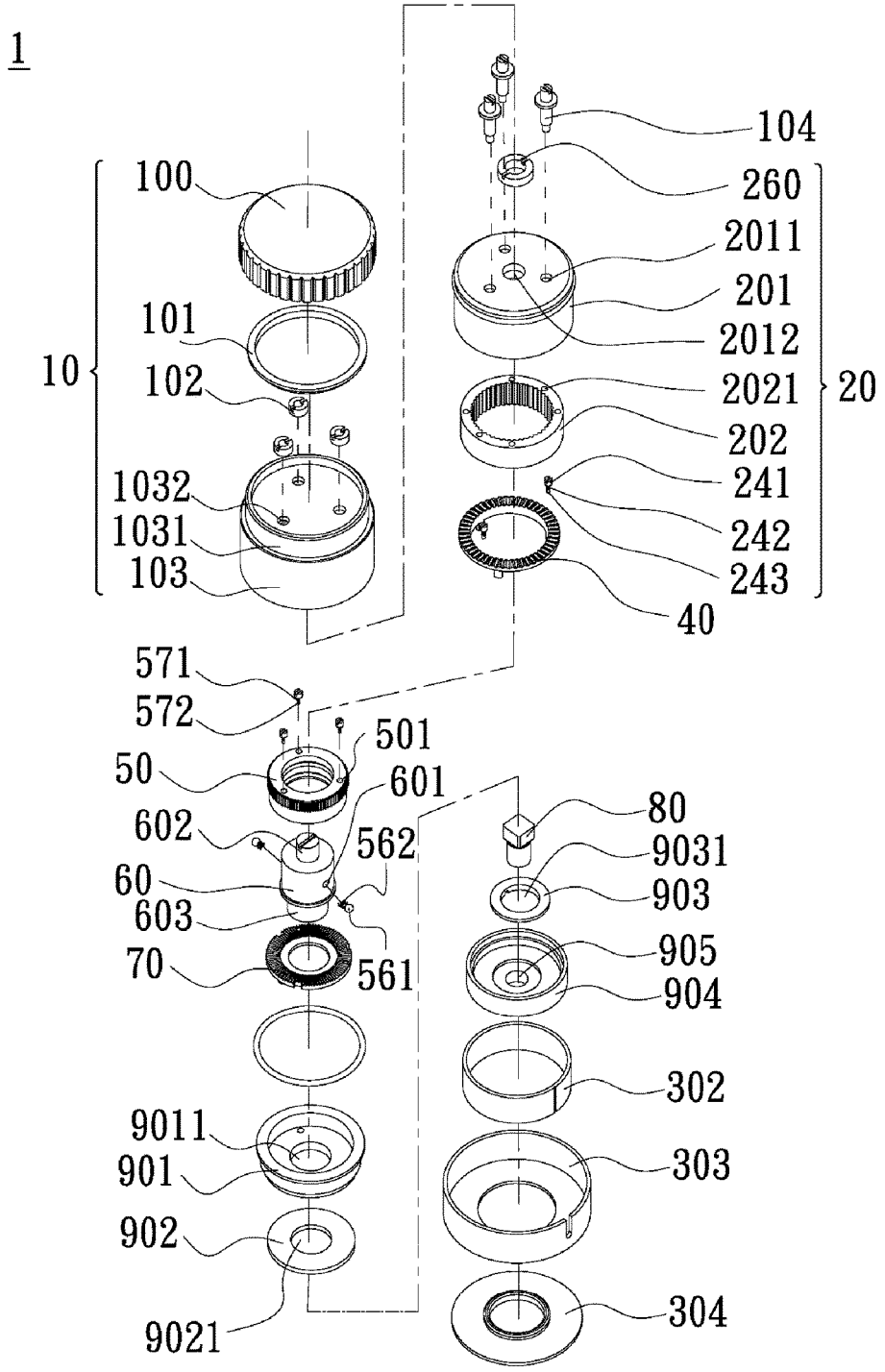
FIG. 1 is an exploded view of an adjusting knob mechanism in accordance with an embodiment of the invention.

An adjusting knob mechanism 1 in accordance with an embodiment of the invention includes an adjusting cover 10, a limiting element 20, a movable element 50, a first clicking gear 40, a second clicking gear 70, an adjusting element 80 and a base 90. In operation, the adjusting cover 10 is rotated so that the adjusting knob mechanism 1 makes clicking sounds, is rotated to move the adjusting element 80 in an axial direction of the base 90 relative to the base 90, and is selectively positioned in two different positions for changing the time intervals of the clicking sounds.

Referring to FIG. 1, the adjusting cover 10 includes a top cap 100 and a cover body 103. The cover body 103 has a protruded portion 1031. The protruded portion 1031 is provided with three fixing holes 1032 respectively formed on a plane portion thereof, and three compression rings 102 are respectively disposed on the plane portion and correspond to the fixing holes 1032. A washer 101 is disposed on a flange portion of the protruded portion 1031. The top cap 100 is placed to cover the protruded portion 1031 with the washer 101 clamped between the top cap 100 and the cover body 103. Such arrangement is able to enhance the sealability of the adjusting cover 10. A connecting mechanism includes at least two fixing screws 104. Each of the fixing screws 104 has a first end portion extending through the fixing holes 1032 and fixed to the cover body 103 by the compression ring 102 and a second end portion extending into the limiting element 20.

Figure 2:
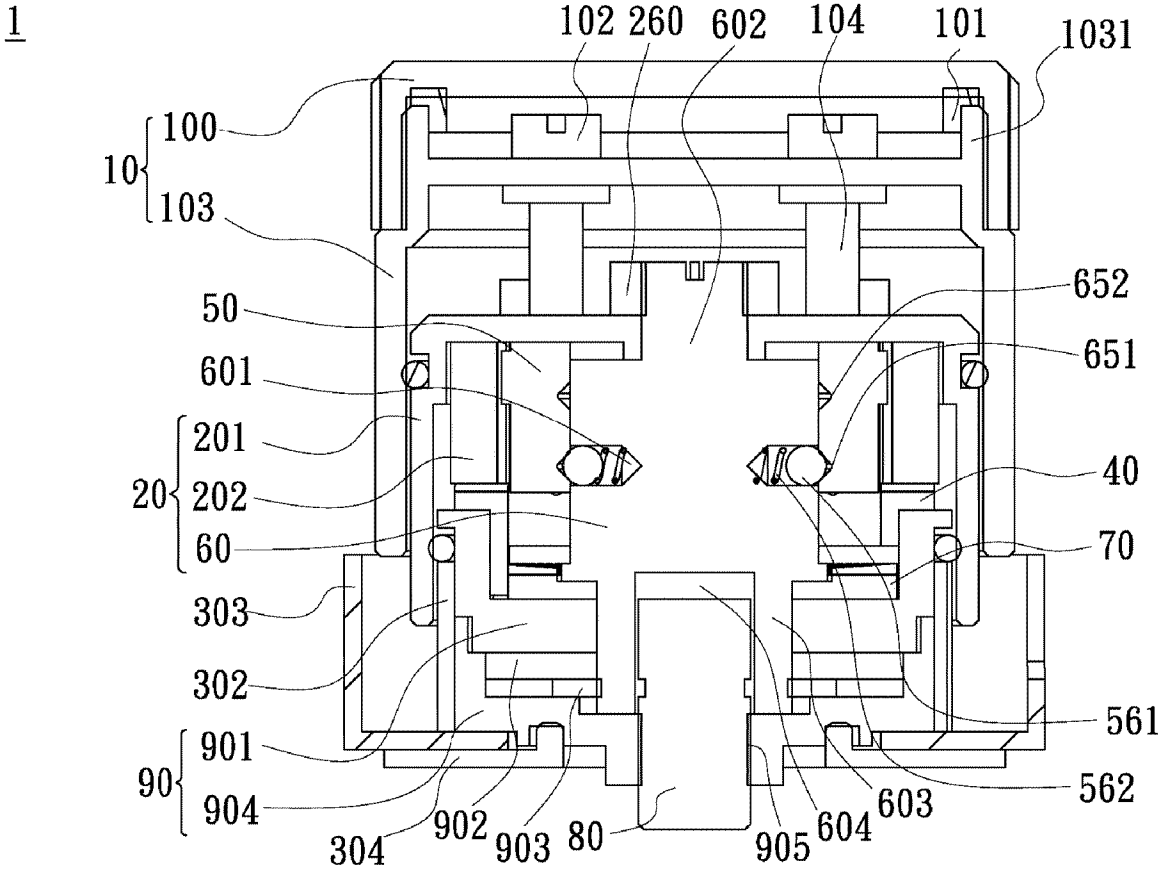
FIG. 2 is a side sectional view of the adjusting knob mechanism of the FIG. 1 wherein an adjusting cover thereof is positioned in a third position.
Figure 3:
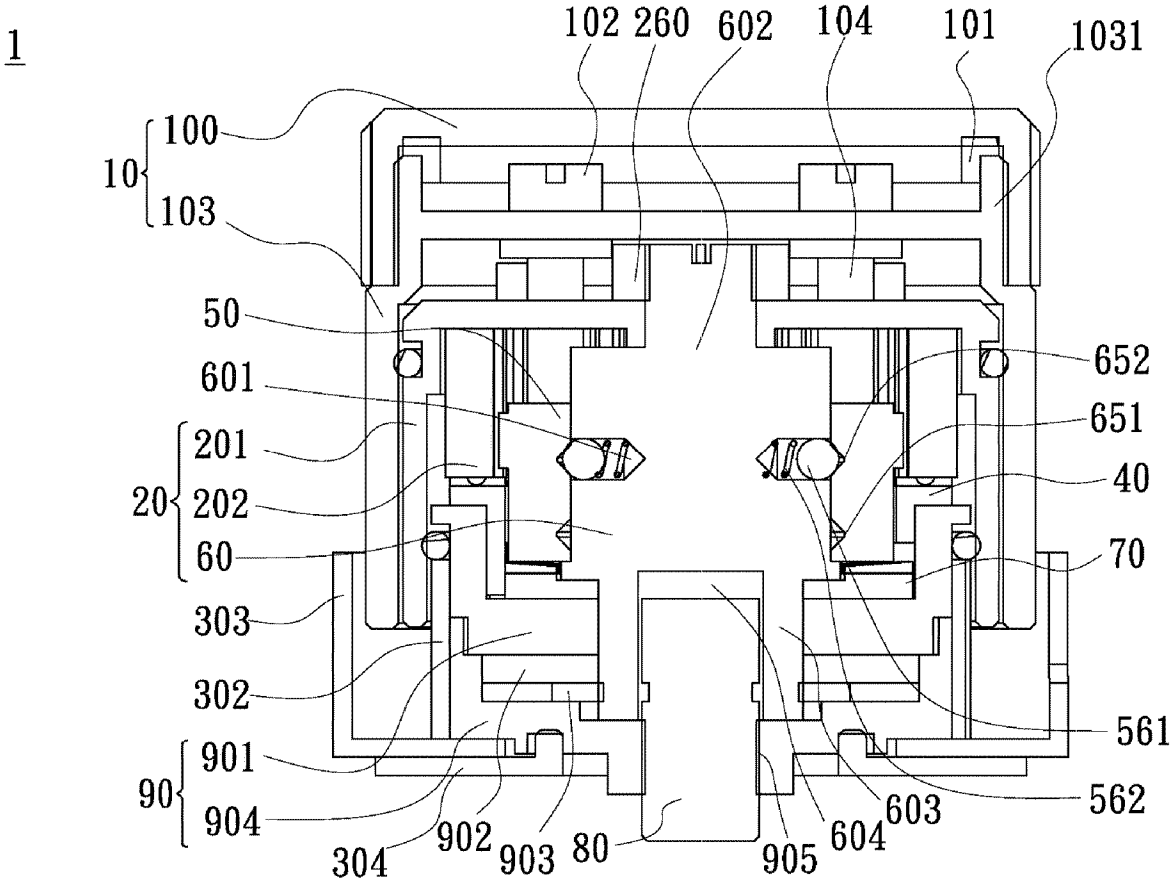
FIG. 3 is a side sectional view of the adjusting knob mechanism of the FIG. 1 wherein an adjusting cover thereof is positioned in a fourth position.

Referring to FIGS. 1, 2 and 3, the limiting element 20 includes a limiting body 201, an adjusting ring 202 and a fixing element 60. The limiting body 201 is provided with three through holes 2011 formed on a plane portion thereof and corresponding to the fixing screws 104. The fixing screws 104 are penetrated through the through holes 2011 and allowed to move relative to the limiting body 201. The limiting body 201 is fixed to a first protruded portion 602 of the fixing element 60 by a compression ring 260 and a central hole 2012 of the plane portion. The adjusting ring 202 is disposed inside the limiting body 201. Further, the fixing element 60 is provided with a second protruded portion 603 opposite to the first protruded portion 602. The second protruded portion 603 has a limiting hole 604 formed on a center thereof. The adjusting element 80 is movably disposed in the limiting hole 604. It is noted that the adjusting cover 10, the fixing screws 104 and the limiting element 20 are linked together. Therefore, the limiting element 20 and the adjusting element 80 can be rotated by rotating the adjusting cover 10. The limiting element 20 is disposed on the base 90 by way of the second protruded portion 603. The base 90 has an adjusting hole 905 at the center thereof. The adjusting element 80 extends in the limiting hole 604 and the adjusting hole 905 and projects from the adjusting hole 905. In the present embodiment, the adjusting element 80 is an adjusting screw. The adjusting cover 10 is able to axially move the adjusting element 80 relative to the base 90 since male threads on an outer cylindrical wall of the adjusting element 80 is engaged with female threads (not shown) on an inner cylindrical wall of the adjusting hole 905.

As shown in FIGS. 1, 2 and 3, the second end portions of the fixing screws 104 extending into the limiting body 201 are fixed to the movable element 50. The adjusting cover 10 can be rotated to rotate the limiting element 20, the movable element 50 and the adjusting element 80 through the fixing screws 104. The movable element 50 is movable in an axial direction of the base 90 in a space between an outer cylindrical wall of the fixing element 60 and an inner cylindrical wall of the adjusting ring 202. In detail, a plurality of first teeth are formed on the inner cylindrical wall of the adjusting ring 202, and a plurality of second teeth formed on an outer cylindrical wall of the movable element 50 is meshed with the first teeth on the inner cylindrical wall of the adjusting ring 202. In addition, two blind holes 601 are formed on an outer cylindrical wall of the fixing element 60. Each blind hole 601 has a ball member 561 and an elastic element 562 disposed therein. The ball member 561 is forced against an inner cylindrical wall of the movable element 50 by an elastic force generated by the elastic member 562. The movable element 50 includes a first annular groove 651 and a second annular groove 652 formed on the inner cylindrical wall thereof, and the second annular groove 652 is closer to the adjusting cover 10 than the first annular groove 651. The movable element 50 is positioned in a first position or a second position by way of the ball member 561 forced against the first annular groove 651 or the second annular groove 652. It is worth noting that the adjusting cover 10 is guided through the fixing screws 104 to be positioned in a third position or a fourth position since the adjusting cover 10 is connected to the movable element 50 by the fixing screws 104.

As shown in FIGS. 1, 2 and 3, the base 90 includes a fixing seat 901 and a base body 904. A compression ring 903 is disposed on a plane portion inside the base body 904, a washer 902 is disposed on the compression ring 903, and the fixing seat 901 is disposed on a flange portion of the base body 904. In detail, the compression ring 903 is provided with a central hole 9031, and a diameter of the central hole 9031 is substantially equal to a diameter of the second protruded portion 603. The washer 902 is provided with a central hole 9021, and a diameter of the central hole 9021 is substantially equal to the diameter of the second protruded portion 603. The second clicking gear 70 is disposed on a first supporting portion inside the fixing seat 901, and the first clicking gear 40 is disposed on a second supporting portion of the fixing seat 901. The fixing seat 901 has a central hole 9011. The second protruded portion 603 is penetrated through the second clicking gear 70, the central hole 9011, the central hole 9021 and the central hole 9031 and against the base body 904. An indicating ring 302 is disposed outside the base 90, and both the indicating ring 302 and the base 90 are disposed in a decoration ring 303. In the present embodiment, the first supporting portion is a planar portion, and the second supporting portion is a flange portion.

Figure 4A:
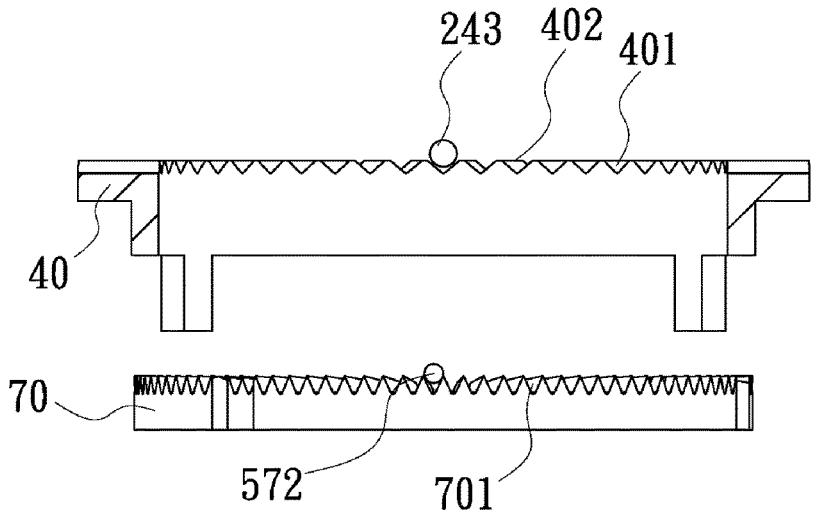
FIG. 4A is a schematic view of the first clicking gear and the second clicking gear of the FIG. 1, with the first and second ball members moved to the first and second indentations.
Figure 4B:
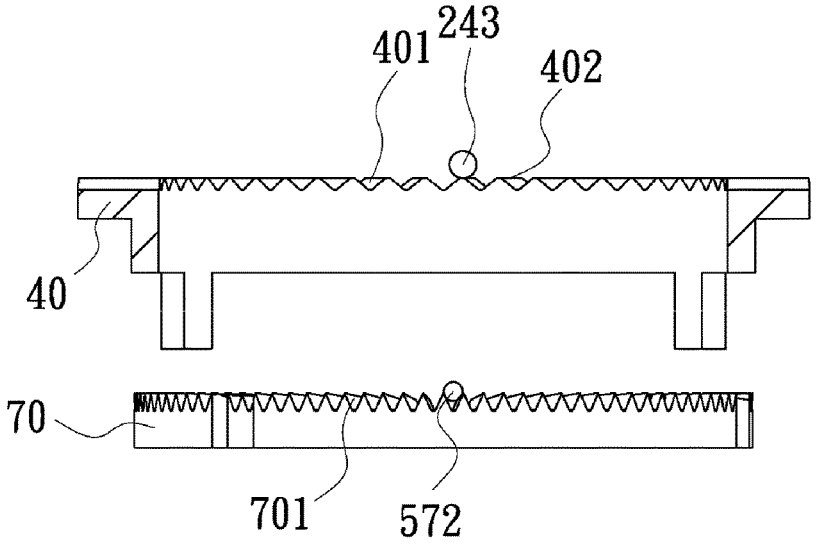
FIG. 4B is a schematic view of the first clicking gear and the second clicking gear of the FIG. 1, with the first ball member moved onto the sector-shaped planes and the second ball member moved to the second indentations.

Referring to FIGS. 4A and 4B, the first clicking gear 40 includes a plurality of first indentations 401 formed radially and equidistantly thereon and a plurality of sector-shaped planes 402 formed between the first indentations 401. The second clicking gear 70 includes a plurality of second indentations 701 formed radially and equidistantly thereon. The number of the second indentations 701 is greater than the number of the first indentations 401. As shown in FIG. 1, the adjusting ring 202 has two through holes 2021 extending axially. In each through hole 2021, a mounting member 241, an elastic element 242 and a ball member 243 are sequentially disposed, wherein the mounting member 241 is fixed in the through hole 2021, and the ball member 243 is forced against the first clicking gear 40 by an elastic force generated by the elastic element 242. Thus, the ball member 243 is moved between the first indentations 401 for making clicking sounds with a first time interval therebetween when the adjusting ring 202 is rotated. Moreover, the movable element 50 is provided with three through holes 501 in which the fixing screws 104 are respectively fixed. In each through hole 501, a ball member 572 and an elastic element 571 are disposed, wherein the ball member 572 is pushed against the second clicking gear 70 by one of the fixing screws 104 through the elastic element 571. Thus, the ball member 572 is moved between the second indentations 701 for making clicking sounds with a second time interval therebetween when the movable element 50 is rotated.

When the adjusting cover 10 is positioned in the third position (as shown in FIG. 2), the adjusting knob mechanism 1 only makes clicking sounds with the first time interval therebetween if the adjusting cover 10 is rotated. When the adjusting cover 10 is positioned in the fourth position (as shown in FIG. 3), the adjusting knob mechanism 1 makes both the clicking sounds of the first time interval and the clicking sounds of the second time interval if the adjusting cover 10 is rotated. In detail, when the adjusting cover 10 is positioned in the third position, the movable element 50 is positioned in the first position and against the planar portion of the limiting element 20, the ball member 561 is engaged with the first annular groove 651, the ball member 243 is placed against the first clicking gear 40, and the ball member 572 is not placed against the second clicking gear 70. If the adjusting ring 202 and the movable element 50 are rotated at the same rate, then only the ball member 243 will be moved between the first indentations 401. When the adjusting cover 10 is positioned in the fourth position, the movable element 50 is positioned in the second position, the ball member 561 is engaged with the second annular groove 652, the ball member 243 is placed against the first clicking gear 40, and the ball member 572 is placed against the second clicking gear 70. If the adjusting ring 202 and the movable element 50 are rotated at the same rate, then the ball member 572 will be moved between the second indentations 701. To match the movement of the ball member 572, the ball member 243 is moved to the first indentations 401 and onto the sector-shaped planes 402 alternately (as shown in FIGS. 4A and 4B) because two adjacent second indentations 701 correspond to a first indentation 401 and a sector-shaped plane 402. It is worth noting that the spacing between the second indentations 701 is smaller than the spacing between the first indentations 401 (in other words, the number of the second indentations 701 is greater than the number of the first indentations 401). That is, if the user hears the clicking sounds of the first time interval, it represents that the adjusting cover 10 is being rotated at a larger angle for each click and the adjusting element 80 is being moved a larger distance relative to the base 90 thereby providing a greater amount of adjustment of the bullet impact point. On the other hand, if the user hears the clicking sounds of the second time interval, it represents that the adjusting cover 10 is being rotated at a smaller angle and the adjusting element 80 is being moved a smaller distance relative to the base 90 thereby providing a smaller amount of adjustment of the bullet impact point.

When the adjusting cover 10 is positioned in the fourth position and is rotated, both the adjusting ring 202 and the movable element 50 are rotated at the same rate so that the adjusting knob mechanism 1 simultaneously makes clicking sounds of the first time interval and the second time interval. However, the user can only recognizes the clicking sounds of the second time interval. Specifically, the clicking sounds of the first time interval generated by movement of the ball member 243 from the sector-shaped planes 402 to the first indentations 401 are overlapped with the clicking sounds of the second time interval generated by movement of the ball member 572 between the second indentations 701. However, no clicking sound is made when the ball member 243 is moved from the first indentations 401 to the sector-shaped planes 402, while the clicking sounds of the second time interval is still made because of movement of the ball member 572 between two others second indentations 701. Therefore, when the adjusting cover 10 is positioned in the fourth position, the user can only hear the licking sounds of the second time interval if the adjusting cover 10 is rotated.

In the above embodiment, the number of the second indentations 701 is greater than the number of the first indentations 401. However, the invention is not necessarily limited thereto. On the contrary, the number of the second indentations (not shown) may be equal to the number of the first indentations 401 (the spacing between the second indentations is equal to the spacing between the first indentations 401). Specifically, the second clicking gear (not shown) has a same structure as the first clicking gear 40. That is, the second clicking gear includes a plurality of second indentations formed radially and equidistantly thereon and a plurality of sector-shaped planes (not shown) formed between the second indentations. During operation of the adjusting knob mechanism 1, the adjusting cover 10 is rotated. If the adjusting cover 10 is positioned in the third position, then the adjusting knob mechanism 1 makes clicking sounds of the first time interval because the ball member 572 is not placed against the second clicking gear. When the adjusting cover 10 is positioned in the fourth position, the ball member 243 and the ball member 572 are respectively placed against the first clicking gear 40 and the second clicking gear. It is worth noting that since the second clicking gear has the same structure as the first clicking gear 40, the adjusting knob mechanism 1 makes two sequences of first-time-interval clicking sounds if the adjusting cover 10 is rotated. However, the user feels that the clicking sounds are made with the second time interval therebetween since the first indentations 401 are aligned with the sector-shaped planes on the second clicking gear (or the second indentations are aligned with the sector-shaped planes 402 on the first click gear 40). By such arrangement, when the ball member 243 is moved from the sector-shaped planes 402 to the first indentations 401 to make a sequence of first-time-interval clicking sounds, the ball member 572 is moved from the second indentations 701 to the sector-shaped planes without making any sounds. When the ball member 243 is moved from the first indentations 401 to the sector-shaped planes 402 without making any sounds, the ball member 572 is moved from the sector-shaped planes to the second indentations 701 to make another sequence of first-time-interval clicking sounds. Therefore, when the adjusting cover 10 is positioned in the fourth position, the two sequences of first-time-interval clicking sounds made by moving the ball member 243 and the ball member 572 respectively on the first clicking gear 40 and the second clicking gear are not overlapped but combined into a sequence of second-time-interval clicking sounds.

The ball member 561, 243 or 572 described in the above embodiments of the invention may be a steel ball, and the elastic element 562, 242 or 571 described in the above embodiments of the invention may be a spring.

Figure 5:
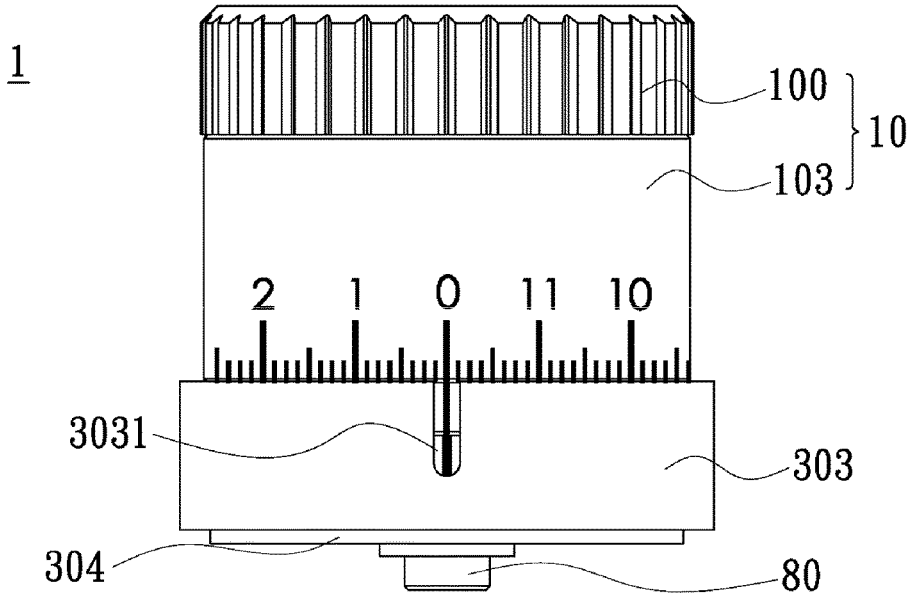
FIG. 5 is a schematic view showing the appearance of the adjusting knob mechanism of the FIG. 2.
Figure 6:
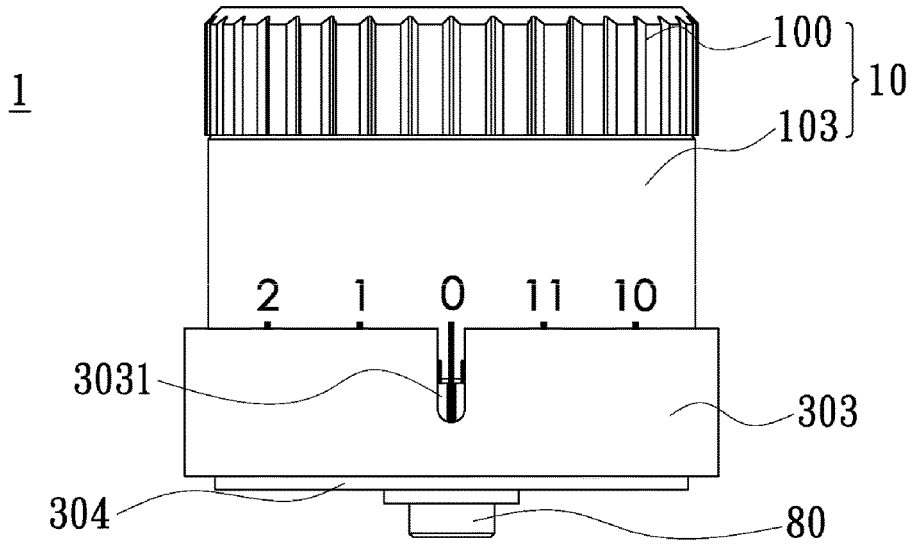
FIG. 6 is a schematic view showing the appearance of the adjusting knob mechanism of the FIG. 3.
Figure 7:
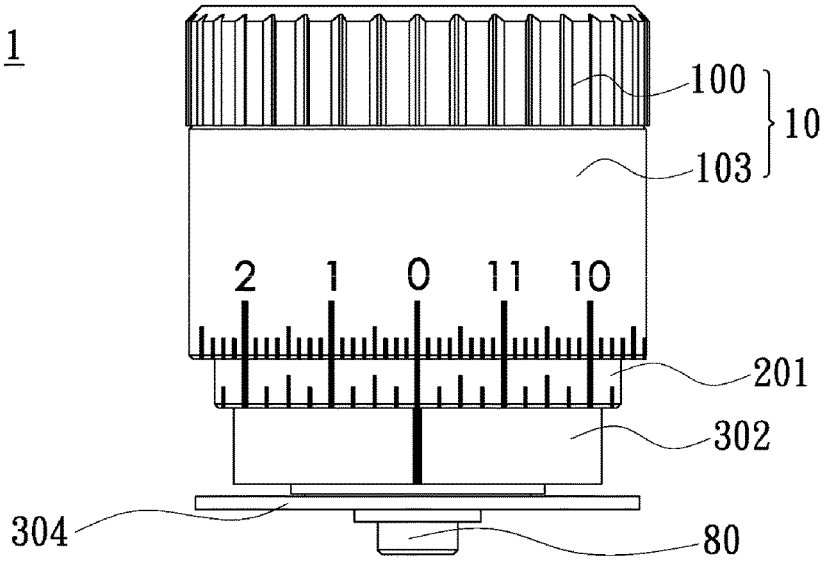
FIG. 7 is a schematic view showing the appearance of the adjusting knob mechanism of the FIG. 2 with the decoration ring removed.
Figure 8:
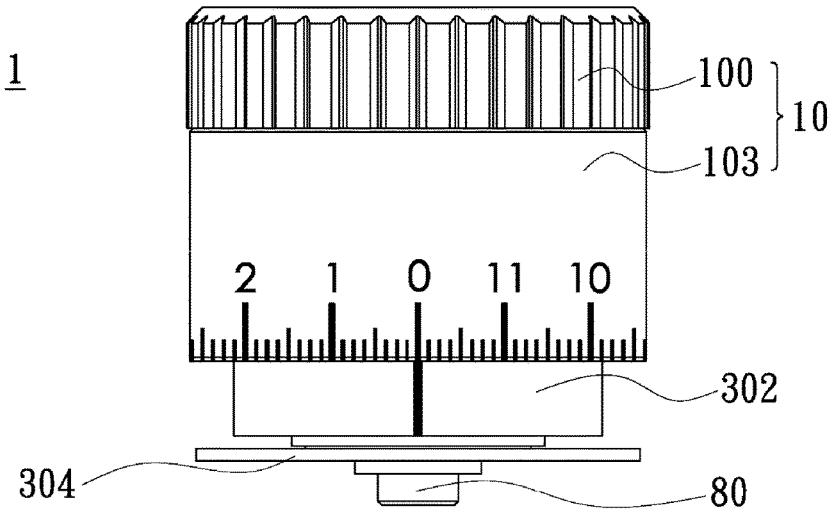
FIG. 8 is a schematic view of the appearance of the adjusting knob mechanism of the FIG. 3 with the decoration ring removed.

Referring to FIGS. 2, 3, 5, 6, 7 and 8, an exterior of the cover body 103 has a fine-tuning scale corresponding to the second indentations 701, an exterior of the limiting body 201 has a coarse-tuning scale corresponding to the first indentations 401, an exterior of the indicating ring 302 has an index, and the decoration ring 303 has an opening 3031 formed on a wall thereof. The index for indicating the fine-tuning scale or the coarse-tuning scale can be recognized through the opening 3031 so as to confirm the actual amount of adjustment of the bullet impact point. When the adjusting cover 10 is positioned in the fourth position, the cover body 103 covers the limiting body 201 so as to cover the coarse-tuning scale (as shown in FIG. 8) and the fine-tuning scale and the index are visible through the opening 3031 (as shown in FIG. 6). When the adjusting cover 10 is positioned in the third position, the coarse-turning scale and the index are visible through the opening 3031 (as shown in FIG. 5).

In another embodiment, the adjusting knob mechanism 1 is disposed on a main body (not shown) of a sight (not shown) through a washer 304 for correcting the bullet impact point of the sight. The adjusting element 80 is placed against an optical unit (not shown) within the main body after assembly of the sight is finished. Therefore, the optical unit can be moved relative to the main body by rotating the adjusting cover 10 so as to perform the elevation or windage adjustment for correcting the bullet impact point of the sight. In particular, the sight is capable of providing two optional operations for correcting the bullet impact point, described in the following:

When the target is at a close distance, since the bullet impact point is needed to be adjusted rapidly, the user may choose a first operation to position the adjusting cover 10 in the third position (as shown in FIGS. 2, 5 and 7) for providing a larger amount of adjustment for correcting the bullet impact point of sight, so that the adjusting knob mechanism 1 can make clicking sounds with the first time interval therebetween to notice the user. Meanwhile, the user may confirm the actual amount of adjustment by observing the coarse-tuning scale indicated by the index through the opening 3031. When the target is at a far distance, since the bullet impact point is needed to be adjusted precisely, the user may choose a second operation to position the adjusting cover 10 in the fourth position (as shown in FIGS. 3, 6 and 8) for providing a smaller amount of adjustment for correcting the bullet impact point of the sight, so that the adjusting knob mechanism 1 can make clicking sounds with the second time interval therebetween to notice the user. Also, the user may confirm the actual amount of adjustment by observing the fine-tuning scale indicated by the index through the opening 3031.

What is claimed is:

1. An adjusting knob mechanism, comprising:

a base comprising a first supporting portion and a second supporting portion;

a first clicking gear comprising a plurality of first indentations and disposed on the second supporting portion;

a second clicking gear comprising a plurality of second indentations and disposed on the first supporting portion;

a limiting element disposed on the base;

a movable element disposed within the limiting element and configured to move in an axial direction of the base relative to the limiting element;

a connecting mechanism extending into the limiting element; and an adjusting cover connected to the movable element by the connecting mechanism, so as to move the movable element in the axial direction of the base relative to the limiting element and the second clicking gear;

wherein the adjusting cover is configured to rotate the limiting element and the movable element through the connecting mechanism.

2. The adjusting knob mechanism as claimed in claim 1, wherein the connecting mechanism comprises at least two fixing screws, each of the fixing screws comprises a first end portion and a second end portion, the first end portion is connected to the adjusting cover, and the second end portion extends through the limiting element and is connected to the movable element.

3. The adjusting knob mechanism as claimed in claim 1, wherein the movable element is movable relative to the limiting element to be positioned in a first position or a second position.

4. The adjusting knob mechanism as claimed in claim 3, wherein the movable element comprises inner circumferential walls on which a first groove and a second groove are provided, the first position corresponds to the first groove, the second position corresponds to the second groove, and both of the first groove and second groove are annular grooves.

5. The adjusting knob mechanism as claimed in claim 3, wherein the limiting element comprises at least one engaging structure, the engaging structure is configured to engage with the movable element in the first position or the second position.

6. The adjusting knob mechanism as claimed in claim 5, wherein the movable element comprises inner circumferential walls on which a first groove and a second groove are provided, the first position corresponds to the first groove, the second position corresponds to the second groove, and both of the first groove and second groove are annular grooves.

7. The adjusting knob mechanism as claimed in claim 6, wherein the engaging structure comprises an elastic element and a ball member, a hole is formed on the limiting element, the elastic element and the ball member are disposed in the hole of the limiting element, and the ball member is forced to engage with the first groove or the second groove by an elastic force generated by the elastic member.

8. The adjusting knob mechanism as claimed in claim 3, wherein the limiting element comprises a planar portion;

when the movable element is positioned in the first position, the adjusting cover is positioned in a third position, the limiting element is placed against the first clicking gear, and the movable element is placed against the planar portion of the limiting element.

9. The adjusting knob mechanism as claimed in claim 8, wherein when the movable element is positioned in the second position, the adjusting cover is positioned in a fourth position, the limiting element is placed against the first clicking gear, and the movable element is placed against the second clicking gear.

10. The adjusting knob mechanism as claimed in claim 9, wherein the limiting element comprises at least one first elastic element and at least one first ball member, a first hole is formed on the limiting element, the first elastic element and the first ball member are disposed in the first hole of the limiting element, and the first clicking gear further comprises a plurality of planes formed between the first indentations;

when the movable element is positioned in the second position, the first ball member is forced against the first clicking gear by a first elastic force generated by the first elastic member;

when the limiting element is rotated, the first ball member is moved to the first indentations and onto the planes alternately.

11. The adjusting knob mechanism as claimed in claim 10, wherein the movable element comprises at least one second elastic element and at least one second ball member, a second hole is formed on the movable element, the second elastic element and the second ball member are disposed in the second hole of the movable element;

when the movable element is positioned in the second position, the second ball member is forced against the second clicking gear by a second elastic force generated by the second elastic member;

when the movable element is rotated, the second ball member is moved between the second indentations.

12. The adjusting knob mechanism as claimed in claim 9, wherein the movable element comprises at least one second elastic element and at least one second ball member, a second hole is formed on the movable element, the second elastic element and the second ball member are disposed in the second hole of the movable element;

when the movable element is positioned in the second position, the second ball member is forced against the second clicking gear by a second elastic force generated by the second elastic member;

when the movable element is rotated, the second ball member is moved between the second indentations.

13. The adjusting knob mechanism as claimed in claim 8, wherein the limiting element comprises at least one first elastic element and at least one first ball member, a first hole is formed on the limiting element, the first elastic element and the first ball member are disposed in the first hole of the limiting element, and the first clicking gear further comprises a plurality of planes formed between the first indentations;

when the movable element is positioned in the first position, the first ball member is forced against the first clicking gear by a first elastic force generated by the first elastic member;

when the limiting element is rotated, the first ball member is moved to the first indentations and onto the planes alternately.

14. The adjusting knob mechanism as claimed in claim 3, wherein when the movable element is positioned in the second position, the adjusting cover is positioned in a fourth position, the limiting element is placed against the first clicking gear, and the movable element is placed against the second clicking gear.

15. The adjusting knob mechanism as claimed in claim 14, wherein the movable element comprises at least one second elastic element and at least one second ball member, a second hole is formed on the movable element, the second elastic element and the second ball member are disposed in the second hole of the movable element;

when the movable element is positioned in the second position, the second ball member is forced against the second clicking gear by a second elastic force generated by the second elastic member;

when the movable element is rotated, the second ball member is moved between the second indentations.

16. The adjusting knob mechanism as claimed in claim 14, wherein the limiting element comprises at least one first elastic element and at least one first ball member, a first hole is formed on the limiting element, the first elastic element and the first ball member are disposed in the first hole of the limiting element, and the first clicking gear further comprises a plurality of planes formed between the first indentations;

when the movable element is positioned in the second position, the first ball member is forced against the first clicking gear by a first elastic force generated by the first elastic member;

when the limiting element is rotated, the first ball member is moved to the first indentations and onto the planes alternately.

17. The adjusting knob mechanism as claimed in claim 16, wherein the movable element comprises at least one second elastic element and at least one second ball member, a second hole is formed on the movable element, the second elastic element and the second ball member are disposed in the second hole of the movable element;

when the movable element is positioned in the second position, the second ball member is forced against the second clicking gear by a second elastic force generated by the second elastic member;

when the movable element is rotated, the second ball member is moved between the second indentations.

18. The adjusting knob mechanism as claimed in claim 3, further comprises an indicating ring and a decoration ring, wherein the indicating ring comprises an index, the decoration ring is provided with an opening, the indicating ring is disposed outside the base, the decoration ring is disposed outside the indicating ring, and the opening is placed to expose the index.

19. The adjusting knob mechanism as claimed in claim 18, wherein the adjusting cover comprises a fine-tuning scale, the limiting element comprises a coarse-tuning scale; the index and the coarse-tuning scale are visible through the opening when the movable element is positioned in the first position; and the index and the fine-tuning scale is visible through the opening when the movable element is positioned in the second position.

* * * * *